United States Patent [19]

Fujimori et al.

[11] 4,160,896

[45] Jul. 10, 1979

[54] HEAT DEVELOPING DEVICE FOR LOCALLY HEAT DEVELOPING A DRY PHOTOSENSITIVE FILM

[75] Inventors: Ryo Fujimori; Hiromi Ito, both of Hachioji, Japan

[73] Assignee: Olympus Optical Co., Ltd., Tokyo, Japan

[21] Appl. No.: 843,348

[22] Filed: Oct. 18, 1977

[30] Foreign Application Priority Data

Oct. 21, 1976 [JP] Japan ..... 51-125458

[51] Int. Cl.[2] ..... H05B 1/00

[52] U.S. Cl. ..... 219/216; 219/388; 432/227

[58] Field of Search ..... 219/216, 388; 354/299; 355/3 FU; 432/8, 59, 227; 250/317, 318, 319; 100/93 P; 165/61

[56] References Cited

U.S. PATENT DOCUMENTS

| | | | |
|---|---|---|---|
| 3,309,881 | 3/1967 | Beerman | 250/493 X |
| 3,936,854 | 2/1976 | Smith | 354/299 |

*Primary Examiner*—C. L. Albritton

*Attorney, Agent, or Firm*—Haseltine, Lake & Waters

[57] ABSTRACT

A heat developing device for locally heat developing a dry photosensitive film composed of a heating unit for locally heating a portion to be heat-developed of the photosensitive film and a cooling unit surrounding the heating unit and placed in contact with the periphery of the portion to be heat-developed of the photosensitive film. The cooling unit functions to prevent the thermal effect applied to the heat-developing portion of the photosensitive film from being transmitted to the remainder of the photosensitive film.

3 Claims, 2 Drawing Figures

HEAT DEVELOPING DEVICE FOR LOCALLY HEAT DEVELOPING A DRY PHOTOSENSITIVE FILM

BACKGROUND OF THE INVENTION

1. Field of the Invention

This invention relates to a heat-developing device for locally heat-developing a dry photosensitive film.

2. Description of the Prior Art

In the case of locally heat-developing a portion to be heat-developed of a dry photosensitive film, heretofore it has been the common practice to use a heater or the like provided with a heating element for heating the heater to a given temperature. The heater is placed into contact with the portion to be heat-developed of the dry photosensitive film so as to locally heat-develope such desired portion. Such conventional heat-developing device has the drawback that the heat conductivity and the like of the photosensitive film causes that portion of the photosensitive film which surrounds the heat-developing portion to be heat developed or to be subjected to adverse influence.

SUMMARY OF THE INVENTION

An object of the invention, therefore, is to provide a heat-developing device which can obviate the above described drawback which has been encountered with the prior art techniques and which can eliminate the adverses influence upon that portion of a photosensitive film which surrounds the desired heat-developing portion of the photosensitive film.

A feature of the invention is the provision of a heat-developing device for a photosensitive film having at least one portion to be heat-developed, said device comprising a supporting means for supporting said photosensitive film and having an opening which is equal in configuration to said portion to be heat-developed, a heating means provided at its lower side with a heating surface brought into contact with said portion of said photosensitive film and locally heating and heat-developing said portion only, and a cooling means for surrounding said heating means and placed in contact with the periphery of said portion to be heat-developed.

The invention will now be described in greater detail with reference to the accompanying drawings.

DESCRIPTION OF THE PREFERRED EMBODIMENTS

Figure 1:
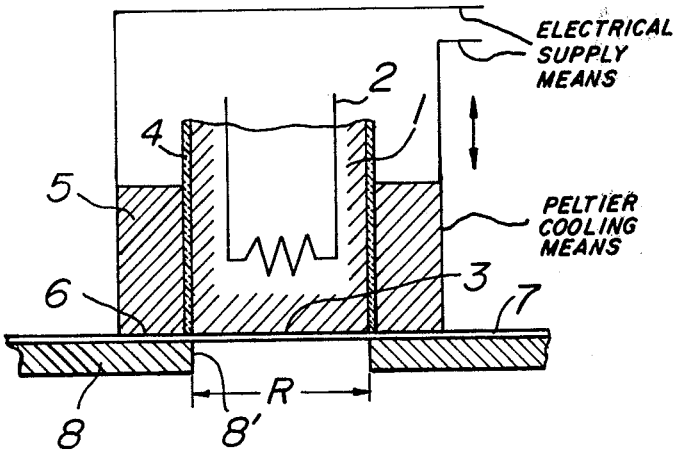
FIG. 1 is a cross-sectional view of one embodiment of a heat-developing device according to the invention.

In FIG. 1 is shown one embodiment of a heat developing device according to the invention. In FIG. 1, reference numeral 1 designates a heater provided with a heating element 2 and at its lower side with a heating surface 3. The heater 1 is formed of a good electrically conductive material and the heating surface 3 is substantially equal in configuration and size to that portion of a photosensitive film 7 which is to be heat-developed. The heating element 2 may preferably be formed of an electric heating wire or the like which makes use of joulean heat. The heater 1 is surrounded through a heat insulating partition wall 4 by a cooling means 5. The cooling means 5 is provided at its lower side with a cooling surface 6 which is arranged in the same plane as the heating surface 3 of heater 1. The cooling means 5 may be composed of an electronic cooling member which makes use of the Peltier effect. The heat insulating partition wall 4 must be interposed between the heater 1 and the cooling means 5.

To both the heating element 2 and the cooling means 5 is supplied electric current from a current supply source (not shown) so as to maintain the heating surface 3 and the cooling surface 6 at suitable temperatures, respectively.

A photosensitive film 7 having at least one portion to be heat-developed is supported by a supporting plate 8 provided with an opening 8' and the heating surface 3 of the heater 1 is brought into contact with the heat developing portion of the photosensitive film 7 which is opposed to the opening 8' of the supporting plate 8, thereby locally heat-developing the photosensitive film 7. During the heat development of the photosensitive film 7, the periphery of the heat-developing portion of the photosensitive film 7 makes contact with the cooling surface 6 of the cooling means 5 and is cooled by the latter. As a result, the periphery of the heat-developing portion of the photosensitive film 7 is prevented from being heated and hence it is possible to prevent the thermal effect applied to the periphery of the heat-developing portion of the photosensitive film 7 from being transmitted to the remainder of the photosensitive film 7. That is, it is possible to locally heat-develop that portion of the photosensitive film 7 which makes contact with the heating surface 3 of the heater 1 and has a desirous range R shown by arrows.

Figure 2:
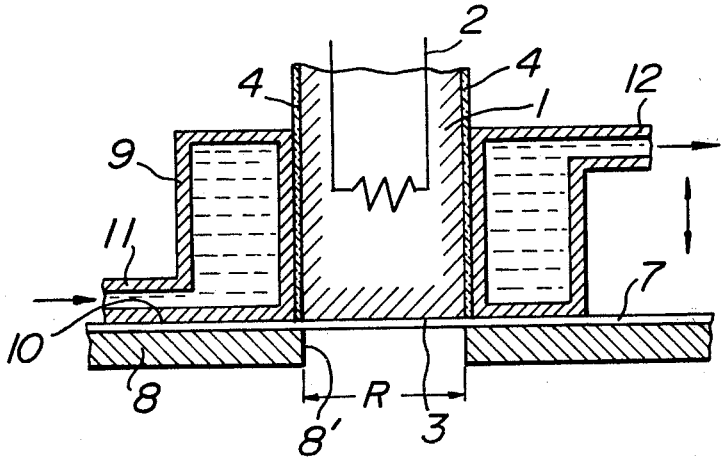
FIG. 2 is a cross-sectional view of another embodiment of a heat-developing device according to the invention.

In FIG. 2 is shown another embodiment of a heat developing device according to the invention. In the present embodiment, the cooling means is composed of an annular chamber 9 provided at its lower side with a cooling surface 10 arranged in the same plane as the heating surface 3 of the heater 1 and provided at one side with an inlet 11 for supplying a cooling medium into the chamber 9 and at its diametrically opposite side with an outlet 12 for discharging the cooling medium.

Similar to the embodiment shown in FIG. 1, the present embodiment can locally heat-develop that portion of the photosensitive film 7 which makes contact with the heating surface 3 of the heater 1 and has a desirous range R shown by arrows.

The invention is not limited to the above embodiments and many modifications, changes and alternations may be made. For example, as the heating means, use may be made of hot air that tends to be blown onto the desirous range R of the photosensitive film 7.

As stated hereinbefore, the invention is capable of heat-developing any desired portion of the photosensitive film without adversely influencing to the remainder of the photosensitive film. Particularly the electronic cooling means shown in FIG. 1 is small in size, light in weight and simple in construction as compared with any other cooling means.

What is claimed is:

1. A heat developing device for a photo-sensitive film having at least one portion to be heat-developed, said device comprising a supporting means for supporting said photosensitive film and having an opening which is equal in configuration to said portion to be heat developed, a heating means provided at its lower side with a heating surface brought into contact with said portion of said photosensitive film and locally heating and heat-developing said portion only, and a cooling means surrounding said heating means and placed in contact with the periphery of said portion to be heat-developed, said cooling means including means for forcedly cooling the periphery of said portion thereby preventing heat transfer thereto.

2. The device according to claim 1, wherein said cooling means is composed of an annular block provided at its lower side with a cooling surface arranged in the same plane as said heating surface of said heating means and provided therein with a cooling element which makes use of Peltier effect and including electrical supply means connected to said annular block.

3. The device according to claim 1, wherein said cooling means is composed of an annular chamber provided at its lower side with a cooling surface arranged in the same plane as said heating surface of said heating means and provided at its one side with an inlet for supplying a cooling medium into said annular chamber and at its diametrically opposite side with an outlet for discharging said cooling medium.

* * * * *